United States Patent [19]

Payne

[11] 4,318,608

[45] Mar. 9, 1982

[54] PORTABLE ELECTROSTATIC PHOTOCOPIER

[76] Inventor: John M. Payne, 13 Crowson Crescent, Northborough, Peterborough, England

[21] Appl. No.: 84,329

[22] Filed: Oct. 12, 1979

Related U.S. Application Data

[63] Continuation of Ser. No. 865,640, Dec. 29, 1977, abandoned.

[30] Foreign Application Priority Data

Jan. 5, 1977 [GB] United Kingdom ..... 140/77

[51] Int. Cl.[3] ..... G03G 15/00

[52] U.S. Cl. ..... 355/3 CH; 355/12; 355/16

[58] Field of Search ..... 355/3 R, 3 CH, 5, 11, 355/12, 16, 14 R; 354/3; 361/225

[56] References Cited

U.S. PATENT DOCUMENTS

| | | | |
|---|---|---|---|
| 2,573,881 | 11/1951 | Walkup et al. | 355/3 DD |
| 3,117,501 | 1/1964 | Oliphant | 355/3 CH |
| 3,168,857 | 2/1965 | Hutto | 355/16 X |
| 3,580,672 | 5/1971 | Ando | 355/3 CH |
| 3,752,571 | 8/1973 | Yamaguchi et al. | 355/3 TE |
| 3,773,416 | 11/1973 | Kushima | 355/16 X |
| 3,964,828 | 6/1976 | Yamada et al. | 355/10 |
| 4,028,596 | 6/1977 | Weber | 361/235 |
| 4,052,730 | 10/1977 | Hochreiter et al. | 354/135 |

*Primary Examiner*—R. L. Moses

*Attorney, Agent, or Firm*—Allison C. Collard; Thomas M. Galgano

[57] ABSTRACT

The development of a compact non-electrical mains supply based photocopier is described in which a piezoelectric crystal generator or a battery operated capacitor discharge circuit EHT supply is employed for generating the high voltage for charging the photoreceptive paper.

The EHT supply for charging the paper is additionally used to provide the source of power for the light source (typically one or more fluorescent gas discharge tubes).

The photocopier incorporates all the facilities to charge and subsequently apply toner and fix the latter in place, with a light-proof housing.

25 Claims, 7 Drawing Figures

Figure 1:
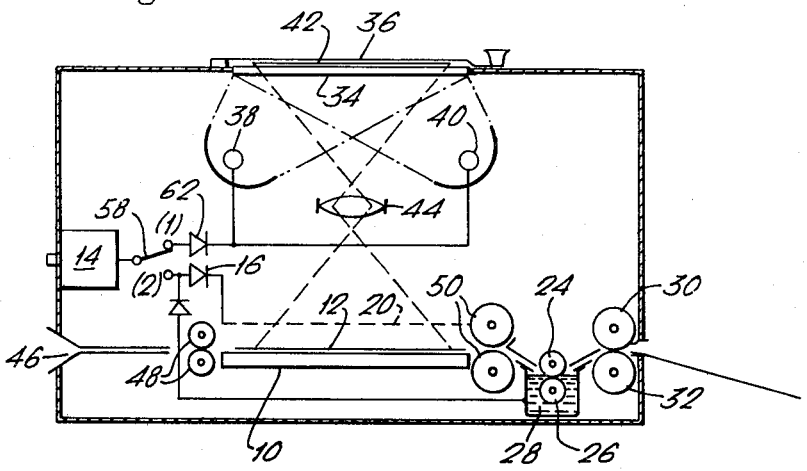

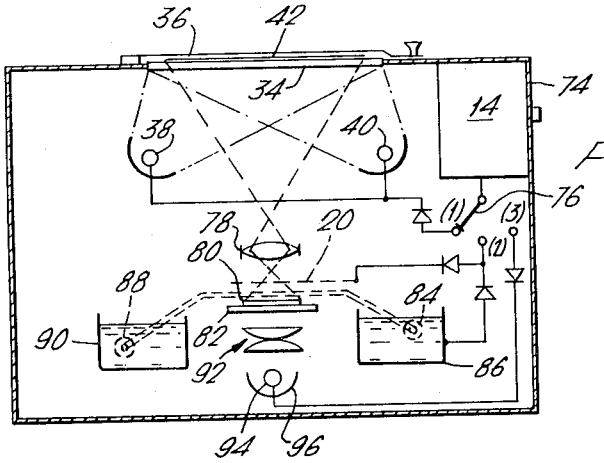
Fig. 4.
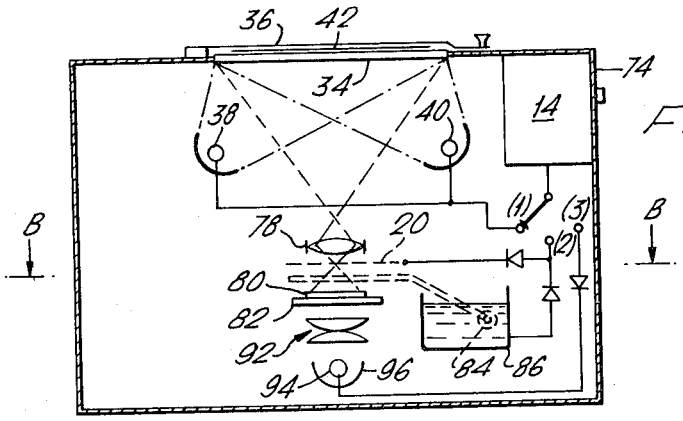
Fig. 5.
Fig. 6.
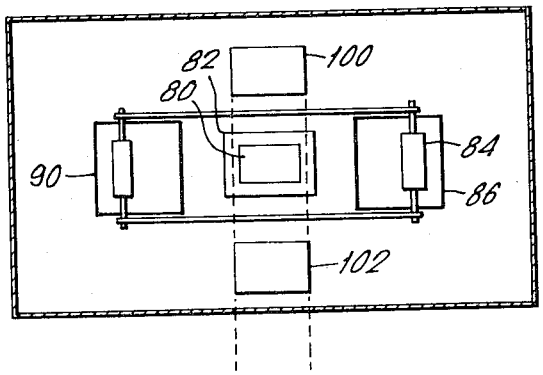
Fig. 7.
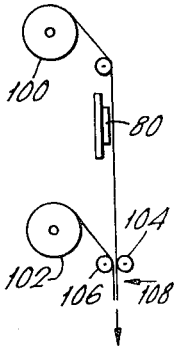

PORTABLE ELECTROSTATIC PHOTOCOPIER

This is a continuation of application Ser. No. 865,640, filed Dec. 29, 1977, now abandoned.

FIELD OF THE INVENTION

This invention concerns electrostatic copying and apparatus therefor.

BACKGROUND OF THE INVENTION

The basic principle behind electrostatic photocopying processes is the fact that when a paper which is coated with a suitable material such as zinc oxide is subjected to an electric charge it will retain that charge unless exposed to light. By exposing the paper to light the charge is dissipated and this factor can be used to build up an electrostatic image in place of an optical image by forming an optical image of a document or scene onto the charged paper whereupon the charge will be dissipated in areas of the optical image which are brightly lit and will be less dissipated or not dissipated at all in areas which are less brightly lit or are dark. The paper containing the electrostatic charge pattern can then be placed in a solution of carbon black and dispersant or carbon powder can be cascaded over the paper and it is found that the carbon black will be attracted to those areas which are still charged. If employed the dispersant is then allowed to evaporate and the carbon is left on the paper or if a powder has been cascaded onto the paper is impregnated into the paper by being rolled between rollers which may be heated.

By using suitable powders and microencapsulated inks, it has been possible to dispense with the heated rollers and simply cold roll the paper so as to impregnate the latter with the carbon.

Depending on the way in which the optical image is formed, it may be necessary to provide for image reversal within such apparatus and this can either be achieved optically by using additional lenses or an intermediate plate may be used sometimes in the form of a drum on which the electrostatic image is formed and to which the carbon powder or carbon black is attracted and against which an ordinary plain piece of paper can then be pressed so as to transfer the carbon from the plate or drum to the plain paper.

OBJECTS OF THE INVENTION

With these points in mind it is an object of the present invention to provide a method and apparatus of photocopying which is of general application to all photocopiers but is of particular application to an apparatus incorporating the minimum of moving parts by which photocopies of flat documents can be obtained cheaply and easily.

It is a secondary object of the invention to provide photocopying apparatus which is of a portable nature.

THE INVENTION

According to the broadest aspect of the present invention, in photocopying apparatus in which a plate (including a sheet of paper or a drum) is charged electrically and then exposed to light to form an electrostatic charge pattern corresponding to an image which is to be copied for attracting thereto powder or encapsulated ink or the like, the electrostatic charge to be applied to the plate is developed using a piezo electric crystal generator or a capacitor discharge circuit.

A piezo electric crystal will produce a high voltage if compressed and an equal and opposite polarity high voltage when the pressure is released and the crystal is allowed to assume its undistorted condition. This dual polarity high voltage can be used to advantage by using one polarity to charge the plate (i.e. paper or drum etc.) and the other polarity to charge the carbon powder or carbon black usually referred to as toner. This dual charging action greatly enhances the attraction of the toner powder to the charged plate. To this end the apparatus preferably includes means for applying a compression force to the crystal and releasing same and synchronous means for diverting the charge of one polarity to the toner and the charge of the other polarity to the plate. Typically the synchronous means for diverting the charges of different polarity comprise diodes but alternatively mechanically operated switches operated in synchronism with the application and withdrawal of the compression force may in addition or alternatively be used.

In order to produce a uniform charge over the plate whether it be a sheet of coated paper or a drum, the electrical output from the generator is applied either to a line of charge transmitting elements each operating on the so-called points discharge principle and located relative to the surface of the drum so that as the latter rotates the charge is transferred equally and evenly to the surface of the drum or in the case of a plain plate, the transmitter comprises a grid of conducting elements such as wires or thin strips of foil and the grid is located above the sheet at a distance therefrom such that whilst the electrical charge from the grid ionizes the air and transfers to the plate as required, at the same time does not produce an in-focus image of itself on the plate when the optical image is projected onto the plate after charging.

Alternatively the charge can be produced from a single point discharge device. The use of an earthed frame produces a more even spread of charge, the frame comprising a ring of wire or conductive strip material which bounds the area over which the charge is to be applied.

Where a flat plate is incorporated the grid used to charge the plate may alternatively be hingeable or slidable between two positions a first dormant position which the grid normally occupies (in which it does not protrude into the optical system which is incorporated to produce an optical image on the charged plate) and a second active position (in which the grid is spaced at an appropriate distance from the plate and lies fully in the optical system to allow charge to be transferred to the plate from the grid). In operation the apparatus is designed to move the grid from the dormant position to the active position just prior to the generation of the high voltage charge and after the charge has been transferred to the plate is adapted to move the grid back to its dormant position so that the plate is ready to have the optical image exposed thereto.

The invention will now be described by way of example with reference to the accompanying drawings.

Figure 2:
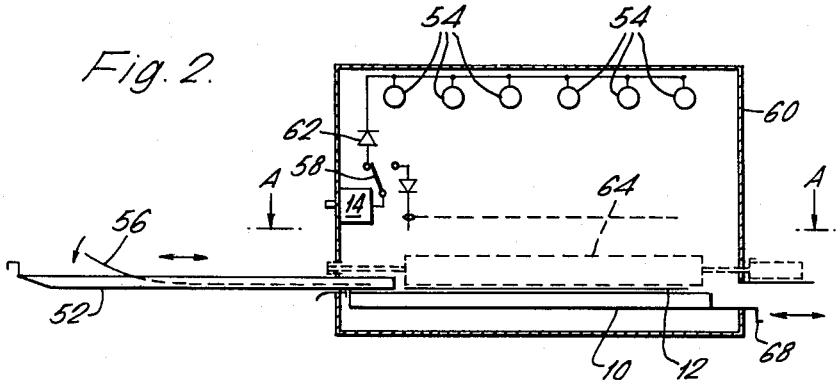
Figure 3:
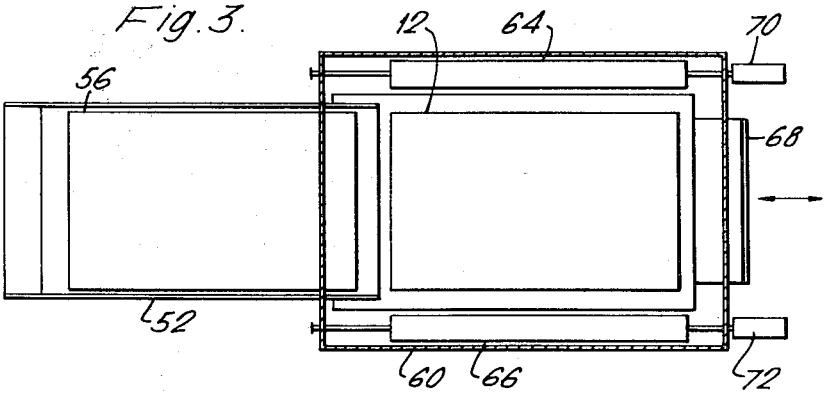

In the drawings:

FIG. 1 is a diagrammatic side view of a first apparatus embodying the invention, FIG. 2 is a similar view of a second apparatus embodying the invention, FIG. 3 is a plan view of the second apparatus sectioned on the line AA, FIG. 4 is a similar view of a third apparatus embodying the invention, FIG. 5 is a similar view of a fourth apparatus embodying the invention, FIG. 6 is a plan view of the fourth apparatus sectioned on the line BB, and FIG. 7 is an end view of the feed and transport of the adhesive backed and plain transparent sheet material incorporated in the fourth apparatus.

Apparatus for producing photocopies from transparencies so that no reversal of the image is required is shown in FIG. 1. This first apparatus comprises a flat bed of electrically insulating material 10 on which a sheet 12 of coated paper can be laid, a piezo electric crystal generator 14 and a diode 16 and conductors 18 and discharge conductor 20 for transferring charge of one polarity from the generator 14 to the paper 12. An optical system including a lens 22 produces an image on the coated paper 12 after the latter has been charged. Rollers 24, 26 and a bath of toner 28 serve to apply a powder or ink to the paper to cause the powder or ink to be attracted to those areas of the paper which remain charged after exposure to the image and a second roller pair 30, 32 for crushing the powder or ink and causing it to become impregnated into the paper to fix the powder or ink image.

The means for applying the powder or ink to the paper may comprise a bath through which the paper is drawn or a reservoir of powder or ink having a transfer roller for picking up powder or ink and transferring the latter to the surface of the paper as the latter is rolled thereover.

The means rollers 30, 32 for fixing the powder or ink to the surface of the paper may be heated by heaters (not shown) or may be cold. Alternatively, not shown, an aerosol spray may be provided for forming a quick drying transparent film of cellulose or the like over the surface of the paper after the carbon or ink has been applied thereto and an image formed thereon.

The document to be copied is laid face down on a glass plate 34 and covered by a flexible light-tight cover 36. The document 42 is illuminated by fluorescent tubes 38, 40. A reversed image of the document is formed by lens 44 on the sheet of charged paper 12.

The paper 12 can be inserted through an opening 46 and is conveyed to and from its position on the plate 10 by transport rollers 48 and 50.

FIGS. 2 and 3 illustrate a second apparatus which includes a frame 52 for holding a transparency and which can be slid into the apparatus to cause the transparency to be brought into contact with the sheet of paper 12 on which the image is to be formed so as to produce a so-called contact print. A number of fluorescent tube lights 54 provide a source of light for illuminating a transparency 56 to form an image thereof on the charged paper 12 so as to produce an electrical charge pattern required for the later stages of the process.

Alternatively, not shown, the light source may comprise a translucent plate through which ordinary ambient lighting can pass. An optical condensing system (not shown) may be incorporated so as to produce substantially uniform illumination of the transparency from ambient light or from a light source incorporating one or more flashlamps or fluorescent tubes.

My co-pending British Patent Application No. 54099/76 describes a light source incorporating a gas discharge tube which may be activated from a piezo electric crystal generator and such a light source may be incorporated in any of the embodiments herein described, so that a secondary source of electricity (either batteries or supply mains) is not required for the light source. In fact the same piezo electric crystal generator may be employed for charging the toner, the paper (or plate) and for energizing the light source. To this end each of the apparatus shown in FIGS. 1 to 3 is assumed to have such a source and a switch 58 is provided for directing the charge from the electrostatic generator 14 as appropriate to the different parts of the apparatus.

FIG. 3 shows the plan layout within the apparatus of FIG. 2. The frame 52 can be slid into and out of the housing 60 to locate the transparency 56, laid thereon, above the sheet 12. After exposure to the light the frame 52 is withdrawn.

A diode 62 (see FIG. 2) ensures that only the appropriate polarity charge reaches the tubes 54 and multiple flashes may be employed to increase the exposure.

In FIG. 1 the exposed sheet 12 is then conveyed through the toner rollers 24, 26 and fixing rollers 30, 32 to produce the photocopy.

In the embodiment of FIG. 2 a roller or brush 64 loaded with toner is moved across the sheet 12 and back to its rest position. Thereafter a roller 66 loaded with lacquer or simply pressing down on the sheet, is moved over the latter and back again to fix the remaining toner onto the sheet, which can then be removed as a finished photocopy from the housing 60 by drawing out the plate 10 by its handle 68. Handles 70 and 72 are provided on the rollers 64 and 66 respectively.

Where reversal of the image is necessary this can be achieved optically using an intermediate lens as in FIG. 1 between the illuminated document and the sheet of charged paper. If no optical system is available (as in FIG. 2) an intermediate step in the process is required. This entails the use of an intermediate plate which may be disposable or comprise part of the FIG. 2 apparatus.

Dealing first with the disposable type of plate, this may comprise a transparent or translucent sheet of plastics material or the like one surface of which is coated with a suitable material such as zinc oxide which can be charged and then exposed to a light image so as to produce an electric charge pattern thereon corresponding to the light image as previously described. By using a transparent medium to form a first photocopy of a reverse image with the coated surface being that which is exposed to the light, a transparency can be obtained which can then be used in a contact type process in the same apparatus using a sheet of ordinary coated paper as the new medium to which the contact light image is applied after charging. The sheet of ordinary coated paper after exposure is then subjected to toner and fixing as previously described to produce a print the correct way round.

It will be appreciated that the sheet of transparent material may be used to produce other prints by the contact process without the need to produce one or more intermediate copies and the intermediate process is therefore most cost effective when a large number of copies of a single document are required. The transparent or translucent intermediate sheet is then discarded at the end of the run or can be stored if required for future use.

Where the apparatus is to be used generally and in the main for single copies from different documents, the cost of the disposable intermediate sheets can be mitigated by using a semi-permanent intermediate sheet of suitable transparent or translucent material coated with the suitable medium such as zinc oxide and the image formed thereon as previously described with reference to the disposable sheet. The intermediate plate containing the reversed image is then exposed to the toner and a reversed print obtained on the coated surface of the intermediate plate and fixed in position using a fixing means which can be removed subsequently so as to remove all traces of the powder or ink so as to render the surface clean and reusable. To this end an aerosol spray or lacquer roller may be used to semi-permanently fix the toner in place so as to produce the reverse transparency needed for subsequent contact prints.

The reverse transparency so produced is then used in conjunction with a sheet of coated paper in the same apparatus so as to expose the sheet of coated paper (after it has been charged) to an optical image of the reversed transparency which when exposed to toner and fixed produces a print the correct way round.

After the appropriate number of copies have been obtained, the surface of the intermediate plate can be cleaned and rendered reusable.

It is of course important that the apparatus previously described (and to be described) is contained within a light-tight housing such as 60 (see FIG. 2) so that after the coated paper or plate (sometimes referred to as a sensitized paper or plate) has been charged electrically, no light falls thereon except as provided by the exposure to the optical image of the document or transparency to be formed thereon.

Where an intermediate plate is required and either a disposable or semi-permanent plate is used, the size of the latter can be reduced by not employing a contact process but by using a lens to form a reduced image of the document or scene to be copied and using a disposable or semi-permanent intermediate transparent plate of commensurate size with the reduced size image. One form of such apparatus is shown in FIG. 4. Having exposed the intermediate plate to the reduced size image and forming the reversed transparency thereon, the optics can be reversed so as to produce an enlarged image of the transparency on a sheet of ordinary coated (sensitized) paper which can then be processed to form a print in a manner as previously described.

The apparatus of FIG. 4 comprises a light-tight housing 74 having a glass plate 34 and flexible cover 36 for locating a document 42 as in FIG. 1. Likewise fluorescent tube lights 38 and 40 are provided for illuminating the document and power therefor is obtained from a piezo electric source 14 when switch 76 is in position (1).

A lens 78 forms a reduced size image of the document on a small sensitized plate 80 carried on a movable support 82.

A first roller/brush 84 from a toner bath 86 is slidable across the plate 80 after exposure and a second roller 88 from a lacquer bath 90, for temporarily fixing the image on the plate.

Below the support 82 is a condensing lens assembly 92 and further fluorescent tube source 94 and reflector 96.

In position (2) switch 70 conveys charge from the source 14 to a charging conductor 20 and in position (3) switch 76 conveys charge to the tube 94.

In use a reversed image transparency is first formed on the plate 80, from a document 42 located on glass plate 34 underneath flexible cover 36, which document is then removed. The switch is then put to position (3) and in darkness a sheet of charged sensitized paper is placed face down on the glass plate 34, so that when the source 14 is operated the light from 94 forms an image of the transparency on the sensitized paper, which can then be processed through a toner bath and fixer (not shown) to produce a finished photocopy.

The advantage of this particular method is that if a lens is to be employed to reverse an image so as to obtain a full size reversed image the spacing between the document to be copied and the plate or sheet of paper must be twice the focal length of the lens. Since a fairly long focal length lens will normally have to be employed, the apparatus is liable to become cumbersome in size if such a distance has to be employed and by adopting this alternative method, a smaller focal length lens may be used with no degradation of optical quality.

In another method which may be based on the full sized contact reversal process previously described or may incorporate a reduced size intermediate plate as just described with reference to FIG. 4, the intermediate plate may be formed by exposing a charged surface to the light image, applying toner thereto but instead of fixing the toner in place, applying a sheet of transparent material having a suitable adhesive transparent backing onto the said surface (with the adhesive side in contact with the said surface) thereby to pick up the toner remaining on the charged areas of the surface. The transparent sheet can then be removed from the said surface and the toner adhering to the adhesive backed surface thereof fixed in place by means of a second sheet of transparent material which may or may not incorporate an adhesive surface but if it does the two sheets of transparent material are located so that the two adhesive backed surfaces are in contact. The toner adhering to the first adhesive surface is trapped between the two sheets of transparent material and a transparency is thereby formed which can then be used for projection purposes to form either a full sized contact print or where a reduced size image has been used, either to produce a reduced sized contact print or by suitable enlargement a full size or even enlarged size print on a sheet of coated paper. The surface which is charged may subsequently be cleaned as by a traversing roller or brush before being re-charged for subsequent exposures.

Apparatus for performing the method just outlined is shown in FIGS. 5 and 6. This apparatus is very similar to that shown in FIG. 4 and the same reference numerals have been used to depict items in common. The chief differences lie in the provision of (a) a cleaning roller/brush 98 in place of the lacquer roller 88, by which the surface of the sensitized plate 80 can be thoroughly cleaned of toner powder, (b) a roll 100 (see FIGS. 6 and 7) of adhesive backed transparent sheet (similar to Sellotape (Registered Trade Mark) with means (not shown) for drawing the tape over the plate 80 and lowering the tape with the adhesive side on the underside into contact with the toner marked charge pattern on the plate (after the latter has been exposed and toner applied thereto by toner roller 84).

(c) a second roll 102 of non-adhesive backed transparent tape, (d) a pair of rollers 104, 106 forming a nip between which the two transparent sheets are squeezed, with the adhesive layer in contact with the upper side of the non-adhesive sheet, so that the two are stuck firmly together and the toner powder adhering to the underside of the first sheet is sandwiched firmly therebetween, and (e) a guillotine 108 (see FIG. 7) for severing the region of the sheet bearing the "transparency".

By removing the plate support 82 and plate 80 and inserting in place the transparency and with switch 76 in position (3), a sheet of charged sensitized paper placed on glass plate 34 can be exposed to the transparency and subsequently processed through a toner bath and fixed as previously described.

It is to be understood that this last aspect is not limited to the use of coated paper as the final medium for impressing the final image thereon but can also be used with a plain paper copier in which an intermediate member such as a plate or drum or the like is used.

Where a full size reverse plate or a suitable master document is available so that it can be laid in contact with a sheet of sensitized paper in a reflex image forming technique the flat surface on which it is laid may comprise the light source and may comprise a translucent sheet with one or more point light sources behind it or may comprise a sheet of semi-conductor material which glows when a suitable potential is applied thereto. However it is to be understood that the invention is not limited to any particular form of light source or any particular form of producing uniform illumination of the said flat bed.

The procedure for forming an image on a charged sheet by a reflex process is then as follows:

1. The sheet of coated paper is laid on the flat bed and in complete darkness is charged electrically.

2. Still in complete darkness the document which is to be copied is laid face down onto the charged surface with the printing or other material which is to be copied in contact with the charged surface.

3. The reverse side of the coated or sensitized paper is then exposed to light for a prescribed interval of time.

4. Again in the dark, the document is removed and toner powder applied thereto.

5. The toner powder which adheres to the charged areas on the paper is then fixed in position either by being rolled so as to impregnate the paper or sprayed with a quick drying material which produces a transparent film over the entire surface of the paper and may for example comprise cellulose or an aerosol.

6. Alternatively instead of fixing the toner powder on the sheet of paper, a sheet of adhesive backed transparent material such as a sheet of Sellotape (Registered Trade Mark) or the like is applied to the surface of the sensitized paper containing the toner image so that the toner remaining on the paper is picked up by the adhesive backed transparent medium. The picked-up toner can be fixed in position by peeling the adhesive backed material from the sensitized paper and sticking the adhesive backed surface onto another sheet of transparent material which may be plain or may itself have an adhesive surface which is laid in contact with the adhesive surface bearing the toner of the first transparent sheet material.

The transparency so produced can then be used to produce positive prints by any convenient photocopying process including those described above, on suitable paper.

I claim:

1. Photocopying apparatus for producing a photocopy of a document comprising:

a member having a surface;

means for causing the surface to be charged electrically with a charge of one polarity comprising a piezo electric crystal generator for generating an electrostatic charge of at least the said one polarity;

means for forming a light image of the document and directing it to the charged surface to form an electrostatic charge pattern corresponding to the image thereon;

a supply of chargeable printing medium to form on the charged surface a visible pattern corresponding to the light image;

a switching device which allows the charge of said one polarity onto to be applied to said surface; and means for supplying to the printing medium a charge of opposite polarity to that of the charge applied to said surface to enhance the attraction of the printing medium to the charged surface comprising a second switching device and circuit means associated therewith for selecting said charge of opposite polarity to said one polarity.

2. The photocopying apparatus as set forth in claim 1, wherein said means for causing the surface to become electrically charged comprises a line of charge transmitting elements each operating on the so-called points discharge principle and located adjacent to the surface, said apparatus further comprising means for effecting relative movement between said surface and said charge transmitting elements so that charge is transferred equally and evenly to said surface.

3. The photocopying apparatus as set forth in claim 1, wherein said means for charging the surface comprises a grid of conducting elements.

4. The photocopying apparatus as set forth in claim 3, comprising means for moving the grid between a first, dormant position which the grid normally occupies and in which it will not cause any image or itself to be formed on said surface during the formation of the light image thereon and a second, active position in which the grid is positioned close to the surface to allow charge to be transferred thereto.

5. The photocopying apparatus as set forth in claim 1, further comprising a single point discharge device and a ring of conductive material which bounds the area of the surface over which the charge is to be applied, to produce a more even spread of charge over the surface.

6. The photocopying apparatus as set forth in claim 1, further comprising a lamp for illuminating the document to be copied to form the said light image, said piezo electric crystal voltage generator being connected in a circuit with the lamp and wherein a switch is connected in said circuit by which electrical energy from said generator is supplied to the lamp to operate the same.

7. The photocopying apparatus as set forth in claim 1, further comprising an optical system for producing a light image of the document in a given plane.

8. The photocopying apparatus as set forth in claim 7, in which the optical system is designed to produce a reversed image of the document in said given plane and there is provided a transparent plate, one surface of which is situated in said given plane and on which a reversed image of the document is formed and on which a reversed photocopy of the image can be formed, the reversed photocopy constituting a document through which light can be passed to form a second light image on a second surface situated in said given plane, the second light image being non-reversed so that a photocopy formed on said second surface has a non-reversed image.

9. The photocopying apparatus as set forth in claim 1, further comprising movable means for conveying the printing medium to the charged surface.

10. The photocopying apparatus as set forth in claim 9, further comprising movable means for conveying a fixing medium to said surface after the printing medium has been applied thereto.

11. The photocopying apparatus as set forth in claim 9, further comprising means for removing the printing medium and fixing medium to allow the surface to be re-used.

12. The photocopying apparatus as set forth in claim 1, further comprising a light-tight housing within which at least light-sensitive component parts of the apparatus are contained.

13. The photocopying apparatus as set forth in claim 7, further comprising:

a transparent plate located in said given plane, one surface of which constitutes said surface on which a photocopy of the image of the document is produced to form a transparency type photocopy; and means for projecting an image thereof onto a second charged surface to produce, after applying printing medium thereto and fixing the adhering printing medium thereon, a photocopy of the transparency type photocopy.

14. The photocopying apparatus as set forth in claim 13, wherein the optical system produces a reduced size image of the illuminated document in said given plane and said optical system is employed in reverse to produce an enlarged version of the transparency type photocopy on said second charged surface.

15. The photocopying apparatus as set forth in claim 1, additionally including a first supply of adhesive backed transparent sheet material, means for applying the adhesive backed sheet material to said surface after printing medium has been applied thereto with the adhesive backing in contact with said surface to pick up on the adhesive backing the printing medium adhering to the charged regions of the surface, a second supply of transparent sheet material and means for applying sheet material from the second supply to the adhesive backing after the latter has been removed from said surface to sandwich therebetween printing medium picked up by the adhesive backing.

16. The photocopying apparatus as set forth in claim 3, further comprising means for projecting the light image through the grid and wherein the grid is spaced from the surface by a distance such that no in-focus light image of the grid will be produced on said surface when the light image is projected through the grid onto said surface.

17. In a photocopying apparatus of the type wherein a first plate is charged electrically and then exposed to form an electrostatic charge pattern corresponding to an image which is to be copied for attracting thereto a printing medium, the combination comprising:

a piezo electric crystal for generating an electrostatic charge to be applied to said first plate;

an optical system for producing a reverse image on a said first plate; and a supplementary transparent plate on which a reversed photocopy image of an illuminated document may be formed and means for illuminating said supplementary transparent plate after the reversed photocopy image has been formed thereon so as to constitute a document from which an image can be formed on said first plate so as to form a photocopy having a non-reversed image of the illuminated document thereon.

18. In a photocopying apparatus of the type wherein a plate is charged electrically and then exposed to light to form an electrostatic charge pattern corresponding to an image which is to be copied by attracting thereto a printing medium, the combination comprising:

a piezo electric crystal for generating an electrostatic charge to be applied to the plate;

an optical system including a first light source for producing an image of an illuminated document on a transparent plate after it is electrically charged;

a transparent plate on which said image is formed so as to produce a transparency-type photocopy;

a second light source for illuminating a transparency-type photocopy;

means for supporting a charged sheet of sensitized paper in contact with the illuminated transparency-type photocopy so as to expose the charged surface to the light image formed by the illumination of the transparency-type photocopy; and means for applying printing medium and fixing medium to the exposed sheet of sensitized paper to form a photocopy of the transparency.

19. In a photocopying apparatus of the type wherein a plate is charged electrically and then exposed to light to form an electrostatic charge pattern corresponding to an image which is to be copied by attracting thereto a printing medium, the combination comprising:

a piezo electric crystal for generating an electrostatic charge to be applied to the plate;

a first supply of adhesive-backed transparent sheet material for applying to the surface of the plate after printing medium has been applied thereto, with the adhesive side in contact with the plate, to pick up thereon the printing medium adhering to the charged regions of the plate; and a second supply of transparent sheet material and means for guiding the sheet material from said second supply into a parallel and contacting path with said adhesive-backed sheet material, with the adhesive-backed surface of the adhesive-backed sheet material in contact with one surface of the sheet material from said second supply, so as to sandwich printing medium picked up from the charged plate between the two sheets of transparent sheet material.

20. In a photocopying apparatus for producing a photocopy of a document, comprising:

a member having a surface;

means for causing the surface to be charged electrically with a charge of one polarity;

means for forming a light image of the document and directing it to the charged surface to form an electrostatic charge pattern corresponding to the image thereon;

a supply of chargeable printing medium to form on the charged surface a visible pattern corresponding to the light image;

a first switching device which allows charge of one polarity only to be applied to said surface of said member; and a second switching device and circuit means associated therewith for causing charge of opposite polarity to the said one polarity to be applied to the said printing medium to enhance the attraction of the said printing medium to the charged surface of said member.

21. The photocopying apparatus as set forth in claim 20, wherein said means for causing the surface to be charged electrically comprises a piezo electric crystal generator for generating an electrostatic charge of at least the said one polarity.

22. The photocopying apparatus as set forth in claim 20, wherein said means for causing the surface to be charged electrically comprises a battery operated capacitor discharge circuit which generates an electrostatic charge of at least said one polarity.

23. The photocopying apparatus as set forth in claim 21, additionally including a light source for illuminating a document to be copied and switch means for connecting the output of said piezo electric generator to said light source so as to supply electrical energy thereto to operate the same.

24. The photocopying apparatus as set forth in claim 22, additionally including a light source for illuminating a document to be copied and switch means for connecting the output of said capacitor discharge circuit to said light source so as to supply electrical energy thereto to operate the same.

25. In a photocopying apparatus for producing a photocopy of a document comprising:

a member having a surface;

means for causing the surface to be charged electrically with a charge of one polarity;

means for forming a light image of the document and directing it to the charged surface to form an electrostatic charge pattern corresponding to the image thereon;

a supply of chargeable printing medium to form on the charged surface a visible pattern corresponding to the light image;

means for supplying to the printing medium a charge of opposite polarity to that of the charge applied to said surface to enhance the attraction of the printing medium to the charged surface;

an optical system for producing a light image of the document in a given plane;

a transparent plate located in said given plane, one surface of which constitutes said surface on which a photocopy of the image of the document is produced to form a transparency type photocopy; and means for projecting an image of said photocopy onto a second charged surface to produce, after applying printing medium thereto and fixing the adhering printing medium thereon, a photocopy of the transparency-type photocopy.

* * * * *